US005337956A

United States Patent [19]

Crutcher

[11] Patent Number: 5,337,956

[45] Date of Patent: Aug. 16, 1994

[54] COMBINATION TOY AND FAUCET FOUNTAIN

[76] Inventor: William C. Crutcher, P.O. Box 276, Middlebury, Conn. 06762

[21] Appl. No.: 15,822

[22] Filed: Feb. 10, 1993

[51] Int. Cl.[5] ..... B05B 17/08; E03B 9/20

[52] U.S. Cl. ..... 239/27; 239/211; 4/678; D23/222; D23/256

[58] Field of Search ..... 239/25, 27, 211; 4/678, 4/661; D23/227, 222, 213, 256, 233

[56] References Cited

U.S. PATENT DOCUMENTS

| | | | |
|---|---|---|---|
| D. 282,563 | 2/1986 | Beene | D23/256 |
| 2,619,770 | 12/1952 | Dinhofer | 239/211 |
| 2,631,060 | 3/1953 | Cook | 239/211 |
| 3,462,080 | 8/1969 | Howard et al. | 239/27 |
| 3,986,639 | 10/1976 | Zaccaro | 222/23 |
| 4,353,139 | 10/1982 | Wainwright et al. | D23/256 |
| 4,821,960 | 4/1989 | Goldman | 239/211 |
| 4,934,597 | 6/1990 | Crutcher | 239/27 |
| 5,125,577 | 6/1992 | Frankel | 239/211 |

FOREIGN PATENT DOCUMENTS 3712802 6/1988 Fed. Rep. of Germany ..... 222/256

*Primary Examiner*—Karen B. Merritt

[57] ABSTRACT

A combination toy and faucet fountain comprises a faucet fountain core including a tubular body with a long front wall and a short rear wall. The tubular body is adapted to frictionally fit over a faucet aerator and has a closure member of sufficient size to cover its outlet end, and a fountain conduit extending upwardly and outwardly from a hole in its front wall to a terminating spout end. The closure member is arranged to be moved to cover the outlet end to direct water from the faucet through the spout end. A flexible plastic jacket encloses the tubular body and the fountain conduit. The jacket has a molded exterior surface depicting at least one fanciful object with an opening located in the object. The object may comprise the likeness of a fanciful character face with features including eyes, nose and mouth. The opening is located in and forms one of the features of the face. Movement of the closure member directs water through the third opening so that it appears to come from the object, as well as being available for drinking.

14 Claims, 2 Drawing Sheets

COMBINATION TOY AND FAUCET FOUNTAIN

BACKGROUND OF THE INVENTION

This invention relates generally to faucet fountains adapted for attachment to faucets for drinking and having fanciful objects or characters with human-like or animal-like features for entertaining children. More particularly the invention relates to an improved construction of such faucet fountains with fanciful characters thereon, enabling more economical manufacture by permitting the manufacturer to readily change the decorative aspects of the depicted fanciful characters or objects without changing the more expensive working components of the faucet fountain.

The vagaries of fad and fashion in children's toys demands constant change to keep up with the current craze. Television, toy companies and publishing industries continually introduce new characters. An industry called character licensing has grown up, in which various and sundry unassociated products are embellished with the features and persona of the latest character which is in vogue. Faucet fountains have been proposed for attachment to faucets or aerators connected to the faucets, which permit normal usage of the faucet, and which also permit alternate use by manual manipulation of a closure member to obtain a flow of drinking water from a spout. Such a fountain has been proposed in U.S. Pat. No. 4,934,597 issued Jun. 19, 1990 to William C. Crutcher, said patent being incorporated herein by reference. This fountain comprised a tubular body with a front wall portion and a rear wall portion, the tubular body having an inlet end adapted to frictionally fit over a faucet and having an outlet end, a closure member attached to the rear wall portion adjacent the outlet end and of sufficient size to cover the outlet end, and a fountain conduit extending upwardly and outwardly from a hole defined in the front wall portion near the outlet end of the tubular body to a terminating spout end, the closure member being arranged to be moved to cover the outlet end to direct water from the faucet through the spout end. The subject patent preferably empoyed an integral plastic body and closure member with a living hinge. The type of faucet fountain mold described above preferably a high volume injection mold, is very expensive. If it is desired to embellish the exterior of the faucet fountain with fanciful character features, a new mold would be required each time a new character is needed.

On the other hand, there are inexpensive molding techniques available for molding sculptures of character faces, enabling complex exterior surfaces on hollow shapes. On technique uses rotational casting of plastic using inexpensive molds, introducing the plastic into the mold interior and rotating it while the plastic cures. The exterior surface of the hollow plastic casting may duplicate a fanciful character figure, face or scene, which is enhanced by painting features onto the exterior surface. Such techniques and plastics are not suitable for manufacturing a faucet fountain, but very adaptable to changing from one fanciful object or character face to the next.

Accordingly one object of the present invention is to provide a faucet fountain embellished with a fanciful object, such as a fanciful character face, which is easy to change to a new character face.

Another object of the invention is to provide an improvement in a faucet fountain which will appeal to children.

Still another object of the invention is to provide a combination toy and faucet fountain which is economical to produce.

SUMMARY OF THE INVENTION

Briefly stated, the invention is practiced by providing a combination toy and faucet fountain comprising a faucet fountain core including a tubular body with a front wall portion and a rear wall portion, the tubular body having an inlet end adapted to frictionally fit over a faucet and having an outlet end, a closure member attached to the rear wall portion adjacent the outlet end and of sufficient size to cover the outlet end, and a fountain conduit extending upwardly and outwardly from a hole defined in the front wall portion near the outlet end of the tubular body to a terminating spout end, the closure member being arranged to be moved to cover the outlet end to direct water from the faucet through the spout end. A jacket encloses the tubular body and the fountain conduit, the jacket defining a first opening surrounding the inlet end, a second opening surrounding the outlet end and adapted to accomodate movement of the closure member while permitting water to flow therethrough, the jacket having a molded exterior surface depicting at least one fanciful object and defining a third opening located in the object. The object may comprise the likeness of a fanciful character face with features including eyes, nose and mouth molded therein, the third opening being located in and forming a part of the features of the face. Movement of the closure member directs water through the third opening so that it appears to come from tile object, as well as being available for drinking.

DRAWING

The objects of the invention will be better understood by reference to the following description, taken in connection with the accompanying drawings, in which:

FIG. 1 is a side elevational view in cross-section, taken along lines I—I of FIG. 3, and illustrating a faucet fountain core disposed inside a jacket, and attached to a water faucet, FIG. 2 is a front elevational view of FIG. 1 with the jacket removed from one half of the figure to show the fountain core inside in accordance with the present invention, FIG. 3 is a front elevational view of the combination toy and faucet fountain attached to a faucet with water running from the faucet, FIG. 4 is a side elevational view of FIG. 3, FIG. 5 is a side elevational view similar to FIG. 4, with water diverted through the toy for use as a drinking fountain, FIG. 6 is a perspective view of a modified faucet fountain core, and FIG. 7 is a perspective view of a modified toy jacket assembled on the fountain core of FIG. 6.

FIG. 8 is a side elevational view of a variation of FIGS. 1–5.

DESCRIPTION OF THE PREFERRED EMBODIMENT

Figure 1:
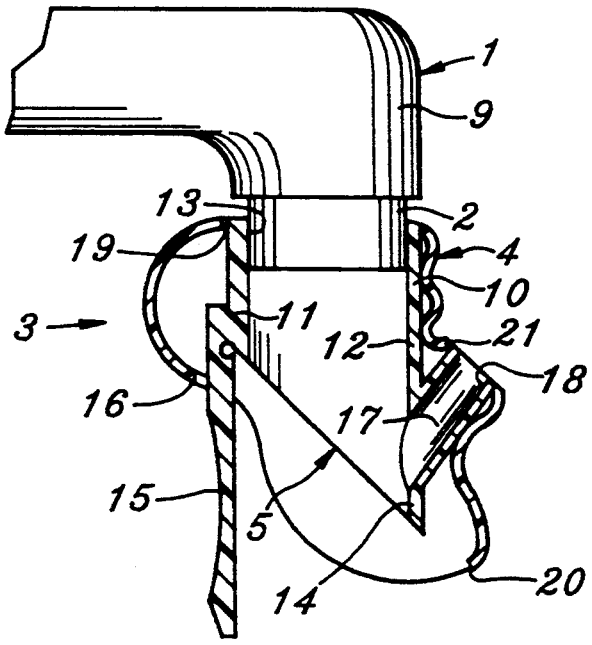
Figure 2:
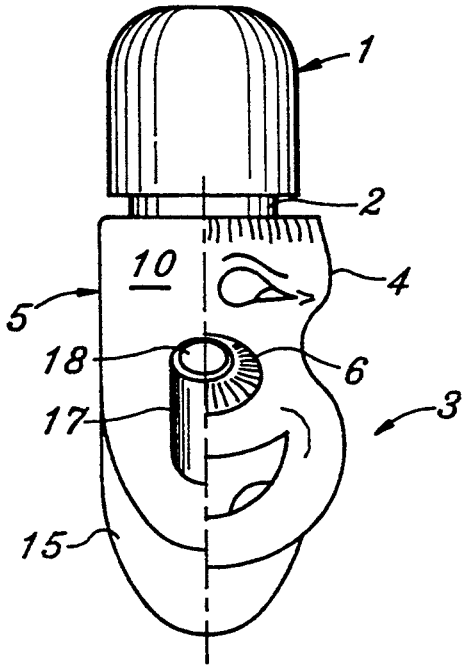

Referring now to FIGS. 1 and 2 of the drawing, a water faucet 1, with an aerator 2, has attached thereto a combination toy and drinking fountain shown generally as 3. The toy/fountain 3 comprises a flexible plastic jacket 4 surrounding a faucet fountain core 5, but arranged to generally hide it from view. The jacket 4 is hollow and has a fanciful object molded on its exterior surface. Here the object is a nose 6 on the face of a clown. Other features are molded on the face such as eyes 7, mouth 8 and hair 9. The clown's face is painted on the exterior surface of the jacket.

Faucet fountain core 5 may be contructed according to the aforementioned U.S. Pat. No. 4,934,597 to comprise a tubular body 10 with a short rear wall portion 11, and a long front wall portion 12, preferably two to three times the length of the rear wall portion. The tubular body 10 has an inlet end 13 adapted to frictionally fit over the end of the faucet aerator 2, an outlet end 14, and a closure member 15 attached to the rear wall adjacent the outlet end 14. Closure member 15 may be injection molded as an integral part of the faucet fountain core 5, and joined to the tubular body by a thin section 16 serving as a living hinge. A fountain conduit 17 is molded as part of the faucet fountain core, which extends upwardly and outwardly from the tubular body 14 to a terminating spout end 18. The closure member 15 is of sufficient size and shape to cover the outlet end 14 and is arranged to be moved by pushing with a finger to cover the outlet end 14 and divert water through the fountain spout end 18 for drinking.

The mold for making the faucet fountain core with living hinge and with accurate measurements is typically expensive. It would be prohibitively expensive to make a new mold each time the exterior of the fountain were altered. If it were desired to depict a variety of character faces and other fanciful objects on a faucet fountain, great expense would result.

In accordance with the present invention, a jacket 4 is constructed and adapted to fit over the faucet fountain core. The jacket is hollow and molded by an inexpensive technique such as rotational casting. A master sculpture of a desired scene or character is fashioned using the exterior of the faucet fountain core as a base. A fanciful object such as a feature on a character face, or an accessory utilized by a character, is located in the vicinity of the terminating spout end 18. In FIG. 2 the nose 6 of the clown's face is the fanciful object on the exterior of jacket 4 from which water will flow.

Figure 8:
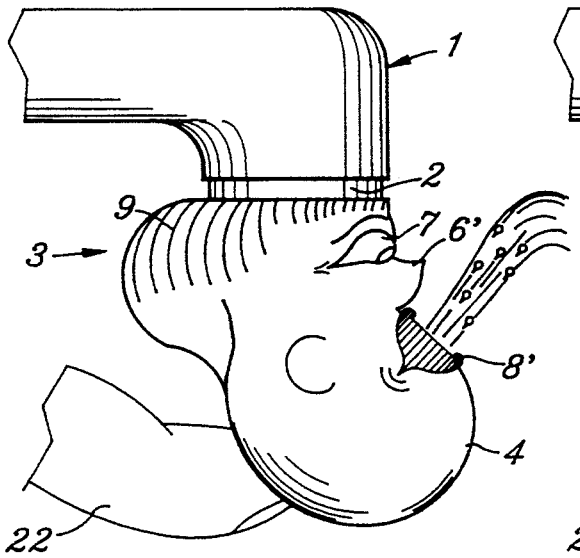

FIG. 8 is a variation of FIGS. 1–5, in which the third opening comprises part of a mouth 8′ rather than the clown's nose 6′, the functions of these elements being interchanged from the mouth 8 and nose 6 of FIGS. 1–5, but still forming part of the features of the face.

The jacket 4 is preferably of flexible plastic material, and defines a first opening 19 surrounding the inlet end 13 of the fountain core tubular body, a second opening surrounding the outlet end of the fountain core tubular body, and a third opening 21 aligned with the terminating end of the fountain conduit. The second opening accommodates movement of the closure member 15. The third opening is located in the object on the jacket, here the clown's nose 6, so that the water appears to come from the clown's nose as well as being available for drinking. Preferably the first opening 19 of the flexible jacket is sized to grip the inlet end 13 of the tubular member by streching the plastic to hold the jacket 4 in place. However the jacket 4 may also be cast of rigid material and supported on the fountain conduit 17 to keep it from coming off.

OPERATION

Figure 3:
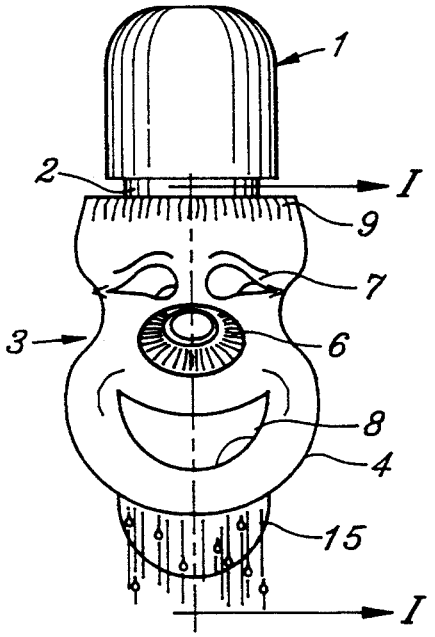
Figure 4:
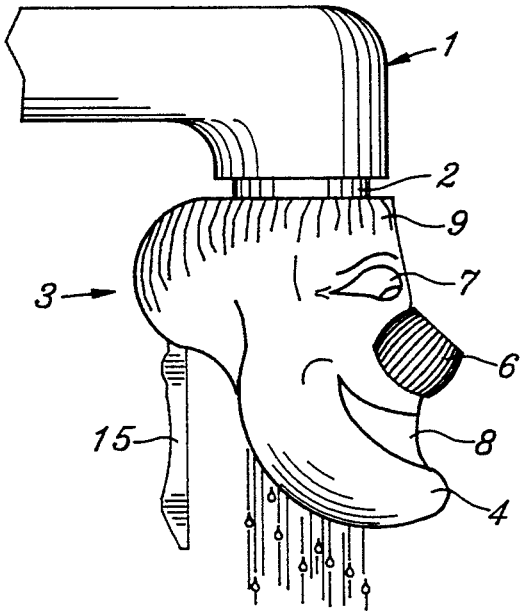
Figure 5:
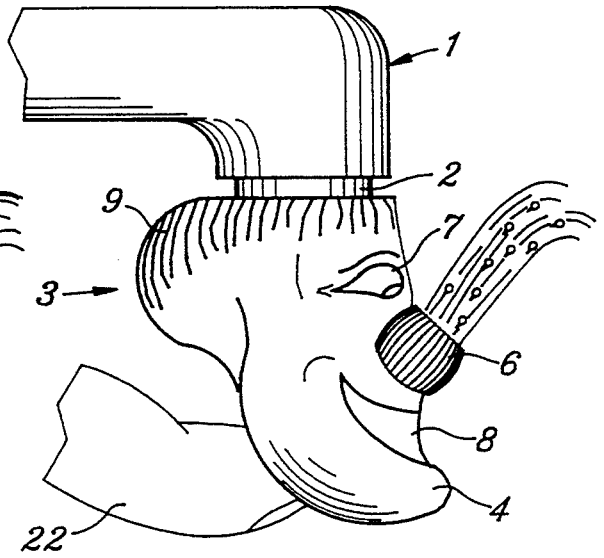

Reference to FIGS. 3, 4 and 5 illustrate the operation. FIGS. 3 and 4 show the faucet in normal use, with water Flowing throught the toy/fountain 3. When a drink is desired closure member 15 is pushed with a finger 22, as shown in FIG. 3. Water is diverted through the fountain conduit when the outlet end of the fountain core as closed. The water is directed upwardly and outwardly for drinking and appears to come from the clown's nose. Any number of different jackets may be substituted to provide different characters or objects, using the same faucet fountain core shape.

Various types of fanciful, characters may be depicted on the jacket, especially cartoon character faces with human-like or animal-like features, using the nose or mouth as the third opening in the jacket. Alternatively, the fanciful object may be an accessory held by a character.

MODIFICATION

Figure 6:
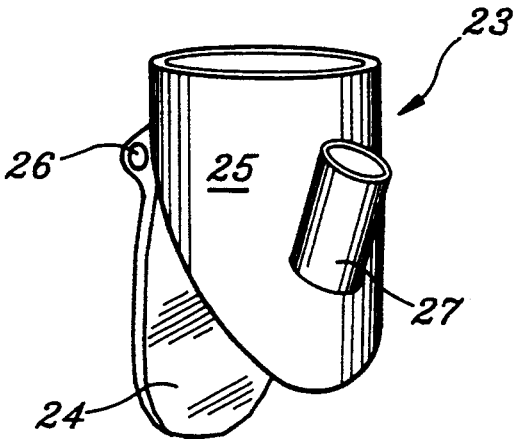
Figure 7:
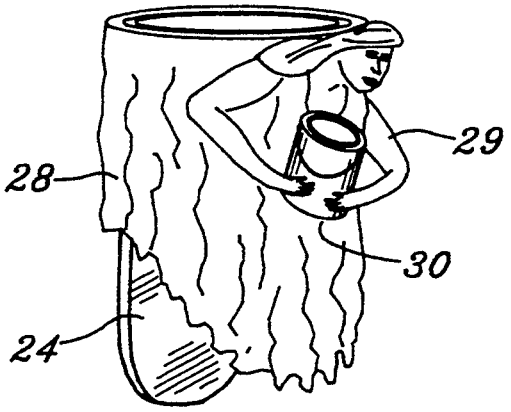

Reference to FIGS. 6 and 7 illustrate a modification of the invention. FIG. 6 shows a faucet fountain core 23 without the jacket. In this case the closure member seen at 24 is separate from the tubular body 25 and is connected thereto by a pin hinge 26, so as to be movable as before. The other details of the fountain conduit 27 and the tubular body itself are similar to those previously described.

FIG. 7 shows an assembled toy/fountain with a jacket 28 depicting a scene of a maiden 29 holding a water pail 30. In this case the third opening of the jacket is located in the water pail, so that when the fountain is operated water appears to come from the pail.

Many other modifications will occur to those skilled in the art and it is desired to secure in the appended claims all such modifications as fall within the true spirit and scope of the invention.

I claim:

1. Combination character toy and faucet fountain comprising:

a faucet fountain core including a tubular body with a front wall portion and a rear wall portion, said tubular body having an inlet end adapted to fractionally fit over a faucet and having an outlet end, a closure member attached to said rear wall portion adjacent said outlet end and of sufficient size to cover said outlet end, and a fountain conduit extending upwardly and outwardly from a hole defined in said front wall portion near said outlet end of said annular body to a terminating spout end, said closure member being arranged to be moved to cover said outlet end to direct water from said faucet through said spout end, and a jacket enclosing said tubular body and said fountain conduit, said jacket defining a first opening surrounding said inlet end, a second opening surrounding said outlet end and spaced therefrom to accomodate movement of said closure member while also permitting water to flow therethrough and a third opening surrounding and engaging said spout end, said jacket having a molded exterior surface depicting at least one fanciful object, said third opening being located in said fanciful object, whereby movement of said closure member directs water through said spout end and through said third opening so that water appears to come from said object as well as being available for drinking.

2. The combination according to claim 1, wherein the fanciful object on the exterior surface of said jacket comprises the likeness of a fanciful character face with features including eyes, nose and mouth molded therein, said third opening being located in and forming a part of the features of said face.

3. The combination according to claim 2, wherein said face is animal-like.

4. The combination according to claim 2, wherein said face is human-like.

5. The combination according to claim 2, wherein said third opening comprises part of said nose.

6. The combination according to claim 2, wherein said third opening comprises part of said mouth.

7. The combination according to claim 1, wherein said fanciful object is an accessory utilized by at least one fanciful character.

8. The combination according to claim 1, wherein said rear wall portion is short and wherein said front wall portion is approximately three times the length of said rear wall portion.

9. The combination according to claim 1, wherein said tubular body and said closure member are of plastic material and integrally attached to one another with a living hinge.

10. The combination according to claim 1, wherein said tubular body and said closure member are of plastic material and pivotably attached to one another.

11. The combination according to claim 1, wherein said jacket is flexible plastic material and wherein said jacket around said first opening tightly engages said tubular body around said inlet end to hold said jacket in place.

12. The combination according to claim 1, wherein said jacket is of rigid plastic material and is arranged to be supported in part on said fountain conduit of said faucet fountain core.

13. Combination character and faucet fountain comprising:

a faucet fountain core including a tubular plastic body with a front wall portion and a rear wall portion, wherein said rear wall portion is short and wherein said front wall portion is approximately three times the length of said rear wall portion, said tubular body having an inlet end adapted to frictionally fit over a faucet and having an outlet end, a closure member integral with said tubular body and flexibly attached to said rear wall portion with a living hinge adjacent said outlet end and of sufficient size to cover said outlet end, and a fountain conduit extending upwardly and outwardly from a hole defined in said front wall portion near said outlet end of said tubular body to a terminating spout end, said closure member being arranged to be flexed to cover said outlet end to direct water from said faucet through said spout end, and a flexible plastic jacket enclosing said tubular plastic body and said fountain conduit, said flexible plastic jacket defining a first opening tightly engaging said inlet end to hold said flexible plastic jacket in place on said tubular plastic body, a second opening surrounding said outlet end and spaced therefrom to accomodate movement of said closure member while permiting water to flow therethrough, and a third opening surrounding and engaging said spout end, said flexible jacket having a molded exterior surface depicting at least one fanciful object, said third opening being located in said object, whereby movement of said closure member directs water through said spout end and third opening so that water appears to come from said fanciful object as well as being available for drinking.

14. The combination according to claim 13 wherein said jacket depicts the likeness of a face with features including eyes, nose and mouth molded therein, and wherein said fanciful object is one of the features of said face, whereby said third opening is located in one of the features of said face.

* * * * *